US011742614B2

(12) United States Patent
Zhang et al.

(10) Patent No.: US 11,742,614 B2
(45) Date of Patent: Aug. 29, 2023

(54) ELECTRICAL CONNECTION DEVICE

(71) Applicants: SHANGHAI DIANBA NEW ENERGY TECHNOLOGY CO., LTD., Shanghai (CN); AULTON NEW ENERGY AUTOMOTIVE TECHNOLOGY GROUP, Shanghai (CN)

(72) Inventors: Jianping Zhang, Shanghai (CN); Danliang Qiu, Shanghai (CN); Chunhua Huang, Shanghai (CN)

(73) Assignees: SHANGHAI DIANBA NEW ENERGY TECHNOLOGY CO., LTD., Shanghai (CN); AULTON NEW ENERGY AUTOMOTIVE TECHNOLOGY GROUP, Shanghai (CN)

( * ) Notice: Subject to any disclaimer, the term of this patent is extended or adjusted under 35 U.S.C. 154(b) by 0 days.

(21) Appl. No.: 17/580,613

(22) Filed: Jan. 20, 2022

(65) Prior Publication Data

US 2022/0140529 A1 May 5, 2022

Related U.S. Application Data

(63) Continuation of application No. 16/624,928, filed as application No. PCT/CN2018/092643 on Jun. 25, 2018, now Pat. No. 11,264,762.

(30) Foreign Application Priority Data

Jun. 23, 2017 (CN) ..... 201710488959.8

(51) Int. Cl.
*H01R 13/64* (2006.01)
*H01R 13/631* (2006.01)
(Continued)

(52) U.S. Cl.
CPC ..... *H01R 13/6315* (2013.01); *H01R 13/05* (2013.01); *H01R 13/11* (2013.01);
(Continued)

(58) Field of Classification Search
CPC .... H01R 13/6315; H01R 13/05; H01R 13/11; H01R 13/28; H01R 13/2421;
(Continued)

(56) References Cited

U.S. PATENT DOCUMENTS 5,169,343 A * 12/1992 Andrews ..... H01R 24/50 439/607.11
7,704,077 B1 * 4/2010 Morley ..... H01R 24/50 439/63
(Continued)

FOREIGN PATENT DOCUMENTS

EP 3573194 A1 11/2019
JP 2005135794 A 5/2005
(Continued)

OTHER PUBLICATIONS

Jul. 21, 2022 Second Office Action issued in European Patent Application No. 18820881.3.
(Continued)

*Primary Examiner* — Thanh Tam T Le

(57) ABSTRACT

An electrical connection device. The electrical connection device comprises a vehicle side electrical connector comprising a first mounting seat, a first high-voltage assembly and a first low-voltage assembly; and a battery side electrical connector comprising a second mounting seat, a second high-voltage assembly and a second low-voltage assembly. The first high-voltage assembly comprises a first high-voltage pole, a flexible electrical connector and a high-voltage plug, wherein the first high-voltage pole includes an electrical contact end and a wiring end; wherein one end of
(Continued)

the flexible electrical connector is in a floating electrical connection with the wiring end of the first high-voltage pole, the high-voltage plug is in a floating electrical connection with the other end of the flexible electrical connector. By means of the electrical connection device, the first high-voltage assembly and the second high-voltage assembly can be prevented from hard damage, the stability of the electrical contact between the first high-voltage assembly and the second high-voltage assembly can be ensured.

18 Claims, 11 Drawing Sheets

(51) Int. Cl.

| | |
|---|---|
| ***H01R 13/05*** | (2006.01) |
| ***H01R 13/11*** | (2006.01) |
| ***H01R 13/24*** | (2006.01) |
| ***H01R 13/502*** | (2006.01) |
| ***H01R 13/52*** | (2006.01) |
| ***H01R 13/639*** | (2006.01) |

(52) U.S. Cl.
CPC ..... *H01R 13/2421* (2013.01); *H01R 13/502* (2013.01); *H01R 13/5202* (2013.01); *H01R 13/639* (2013.01); *H01R 2201/26* (2013.01)

(58) Field of Classification Search
CPC ..... H01R 13/502; H01R 13/5202; H01R 13/639; H01R 13/6215; H01R 13/514; H01R 2201/26
See application file for complete search history.

(56) References Cited

U.S. PATENT DOCUMENTS

| | | | | |
|---|---|---|---|---|
| 8,282,415 | B1 * | 10/2012 | Foltz | H01R 12/724 439/579 |
| 8,465,313 | B2 * | 6/2013 | Shibata | H01R 13/5202 439/271 |
| 9,209,540 | B2 * | 12/2015 | Raff | H01R 12/716 |
| 9,484,667 | B2 | 11/2016 | Ichio | |
| 10,290,974 | B2 * | 5/2019 | Ishibashi | B60L 15/007 |
| 10,498,061 | B1 * | 12/2019 | Blasick | H01R 13/08 |
| 10,630,021 | B2 * | 4/2020 | Shiraishi | H01R 13/502 |
| 10,739,833 | B2 * | 8/2020 | Chai | G06F 1/203 |
| 11,264,762 | B2 * | 3/2022 | Zhang | H01R 13/639 |

FOREIGN PATENT DOCUMENTS

| | | | |
|---|---|---|---|
| JP | 2015179639 | A | 10/2015 |
| KR | 20090004631 | A | 1/2009 |
| WO | 2014147760 | A1 | 9/2014 |

OTHER PUBLICATIONS

Aug. 30, 2022 First Office Action issued in Japanese Patent Application No. 2021-117369.
Sep. 6, 2022 First Office Action issued in Japanese Patent Application No. 2021-117385.
Jul. 29, 2022 First Office Action issued in Korean Patent Application No. 10-2021-7041231.
Dec. 20, 2022 decision of final Rejection issued in Japanese Patent Application No. 2021-117369.
Dec. 20, 2022 Second Office Action issued in Japanese Patent Application No. 2021-117385.
Feb. 17, 2023 Second Office Action issued in Korean Patent Application No. 10-2021-7041231.

* cited by examiner

ELECTRICAL CONNECTION DEVICE

CROSS REFERENCE TO RELATED APPLICATIONS

The present application is a Continuation application of U.S. patent application Ser. No. 16/624,928 filed on Jul. 2, 2020, which is a national-phase application of PCT Application No. PCT/CN2018/092643 filed on Jun. 25, 2018, which claims the priority of the Chinese patent application No. 201710488959.8, filed on Jun. 23, 2017, the contents of which are incorporated herein by its entirety.

FIELD OF INVENTION

The present invention relates to electrical vehicle, in particular relates to an electrical connection device for electrically connecting a battery and the electrical vehicle.

PRIOR ARTS

The existing methods for installing the battery of the electric vehicle include: stationary method and replaceable method, wherein the battery in the stationary method is used to fixed on the vehicle, and the vehicle can be regarded as an object for being recharged directly under such circumstances. However, the battery in the replaceable method is applied by an actively fixing method, and the battery can be taken down at any time in order to change or recharge the battery, and then the battery will be re-installed on the vehicle after being changed or being recharged.

Usually, for the existing battery in the replaceable method, a mounting position is provided on the body bracket of the vehicle. The battery is then connected to the vehicle side electrical connector on the vehicle by a battery side electrical connector, and is locked by a locking device. In this process, the electrodes of the battery side electrical connector on the battery need to connect the electrodes of the vehicle side electrical connector, such that the electric power can be ensured.

However, the existing traditional vehicle side electrical connector are applied with sedentary electrodes to plug with the battery side electrical connector, and it will be damaged easily when the electrodes are acted by a force in vertical direction.

CONTENT OF THE PRESENT INVENTION

The present invention provides an electrical connection device to overcome the defect that pole is easily damaged when suffering a vertical extrusion force, which is caused by the traditional vehicle side electrical connector with a fixed pole is plugged into the battery side electrical connector.

The present invention uses the following technical solutions to solve the above technical problems:

An electrical connection device comprises:

A vehicle side electrical connector includes a first mounting seat, a first high-voltage assembly, a first low-voltage assembly, wherein both the first high-voltage assembly and the first low-voltage assembly are configured to be inserted through the first mounting seat;

A battery side electrical connector includes a second mounting seat, a second high-voltage assembly, a second low-voltage assembly, wherein the second high-voltage assembly and the second low-voltage assembly are configured to be inserted through the second mounting seat, wherein the first high-voltage assembly and the second high-voltage assembly are in a separable planar electrical connection, wherein the first low-voltage assembly and the second low-voltage assembly are in a separable planar electrical connection, wherein the first mounting seat and the second mounting seat are in a detachable seal connection, and wherein the first mounting seat is configured to be opposite to the second mounting seat.

In this technical solution, the first high-voltage assembly of the vehicle side electrical connector and the second high-voltage assembly of the battery side electrical connector are in planar electrical connection, which can possess a certain floating displacement due to the extrusion along the axis therebetween, in order to eliminate the generated extrusion force so that the first high-voltage assembly and the second high-voltage assembly can be prevented from hard damage, and the stability of the electrical contact between the first high-voltage assembly and the second high-voltage assembly can also be ensured.

Besides, the first low-voltage assembly of the vehicle side electrical connector and the second low-voltage assembly of the battery side electrical connector are in planar connection, the contact area of the electrical connection between the low-voltage assembly of the vehicle side electrical connector and the low-voltage assembly of the battery side electrical connector can also be ensured, thereby ensuring the reliability of the electrical connections of the two parties.

Furthermore, the first mounting seat and the second mounting seat are in a detachable seal connection, which can form a seal construction between installed vehicle side electrical connector and installed battery side electrical connector, and hence improve the waterproof performance of the vehicle side electrical connector and the battery side electrical connector.

Preferably, the first high-voltage assembly includes a first high-voltage pole, wherein the first high-voltage pole includes an electrical contact end and a wiring end, wherein the electrical contact end is protruded out of a surface opposite to the second mounting seat in the first mounting seat, wherein a groove is provided on an end surface of the contact end, wherein the groove is recessed inward along axial direction of the first high-voltage pole, wherein a first conductive elastic component is embedded in the groove, and wherein the first conductive elastic component is protruded out of the end surface of the electrical contact end;

The second high-voltage assembly includes a second high-voltage pole, wherein the second high-voltage pole includes an electrical contact end and a wiring end, wherein the electrical contact end of the second high-voltage pole is parallel with a surface opposite to the first mounting seat in the second mounting seat, wherein the electrical contact end of the second high-voltage pole is in a separable planar electrical connection with the electrical contact end of the first high-voltage pole by the first conductive elastic component, and wherein the first conductive elastic component is configured to be pressed between the groove and the electrical contact end of the second high-voltage pole.

In this technical solution, a groove is set at the electrical contact end of the first high-voltage pole of the vehicle side electrical connector and a first conductive elastic component is provided in the groove. The first conductive elastic component can perform elastic deformation when is extruded by the battery side electrical connector and also can keep a good contact once eliminating the extrusion force, and thereby can achieve a high-voltage planar connection between the vehicle side electrical connector and the battery side electrical connector, in order to adapt a stable electrical connection therebetween in a vibrating vehicle body condition.

Preferably, the groove is an annular groove, wherein axis of the annular groove is in overlapped with axis of the first high-voltage pole;

And/or the first conductive elastic component is a conductive spring;

And/or contact surface of the electrical contact end of the first high-voltage pole and the second high-voltage pole are flat surfaces.

In this technical solution, contact surface of the electrical contact end of the first high-voltage pole and the second high-voltage pole are flat surfaces, and thus the contact area of the first high-voltage pole of vehicle side electrical connector and the second high-voltage pole of battery side electrical connector can be ensured thereby ensuring the reliability of electrical connection between the two parties.

Preferably, the first high-voltage assembly also comprises:

A flexible electrical connector, wherein one end of the flexible electrical connector is in a planar electrical connection with the wiring end of the first high-voltage pole;

A high-voltage plug, wherein the high-voltage plug is in a planar electrical connection with the other end of the flexible electrical connector.

In this technical solution, both end of the first high-voltage pole are in planar electrical connections through the flexible electrical connector, which prevents abnormal conditions such as electrical connection failure or overburning caused by loose connection, and also increases the stability of the electrical connection between the vehicle side electrical connector and the battery side electrical connector.

In addition, the high-voltage plug is in a planar electrical connection with the first high-voltage pole through the flexible electrical connector, which increases the stability of the electrical connection between the first high-voltage pole and the high-voltage plug when moving in axial direction and rotating in radial direction, and thus increases the safety and electrical conductivity of the electrical connection device.

Preferably, a wiring slot is provided on the wiring end of the first high-voltage pole, wherein the wiring slot is recessed inward along axial direction of the first high-voltage pole, wherein one end of the flexible electrical connector is configured to be pressed to connect with the wiring slot, and wherein a second conductive elastic component is pressed between the inner walls of the wiring slot.

In this technical solution, using the structure stated above, the stability of the electrical connection between the first high-voltage pole and the flexible electrical connector is enhanced by achieving the floating connection between the first high-voltage pole and the flexible electrical connector through the second conductive elastic component.

Preferably, the flexible electrical connector comprises:

A first electrical connector, wherein one end of the first electrical connector is configured to be pressed to connect with the wiring slot, and wherein a second conductive elastic component is pressed between the inner walls of the wiring slot;

A flexible cavity, wherein one end of the flexible cavity is configured to be pressed to connect or be welded with the other end of the first electrical connector, and wherein the flexible cavity is located outside the first high-voltage pole and the high-voltage plug, and is made of flexible conductive material;

A second electrical connector, wherein one end of the second electrical connector is configured to be pressed to connect or be welded with the other end of the flexible cavity, and wherein the other end of the second electrical connector is in a planar electrical connection with the high-voltage plug;

A spring, wherein the spring is located within the flexible cavity, and two ends of the spring are connected with the first electrical connector and the second electrical connector respectively;

In this technical solution, using the structure stated above, when the flexible electrical connector is in use, the flexible cavity can be stretched, compressed or rotated radially in order to adapt the relative displacement changes in axial, radial and all angles between the structural connections, and prevents poor the electrical connection performance caused by changing the relative displacement and increased the stability of the electrical connection of the vehicle side electrical connector dramatically.

Besides, the flexible cavity is configured to be pressed to connect or be welded with the first electrical connector and the second electrical connector, which enhances the structural connection strength of the flexible electrical connector and ensures the stability of the electrical connection of the flexible electrical connector.

Furthermore, the spring can effectively increases the structural strength of the flexible electrical connector, hence two ends of the flexible cavity can also ensure the electrical connection performance of the flexible electrical connector during changing the relative displacement, and the spring also possesses conductive function and further improving the stability of the electrical connection between the first electrical connector and the second electrical connector.

Preferably, the high-voltage plug includes a plug pin, wherein the other end of the flexible electrical connector is in planar electrical connection with the plug pin of the high-voltage plug through a connecting socket base, wherein one end of the connecting socket base is provided with a first socket hole, and the other end of the connecting socket base is provided with a second socket hole, wherein one end of the flexible electrical connector is configured to be pressed to connect within the first socket hole, wherein the plug pin is in a planar connection with the second socket hole, and also a third conductive elastic component is configured to be pressed to connect within the flexible electrical connector and the inner wall of the first socket hole and/or the plug pin and the inner wall of the second socket hole.

Preferably, the second mounting seat is provided with a high-voltage mounting hole, wherein the second high-voltage pole is configured to be inserted through the high-voltage mounting hole wherein outer wall surface of the second high-voltage pole is provided with a positioning section which is used to limit the movement of the second high-voltage pole relative to the second mounting seat along axial direction of the high-voltage mounting hole.

In this technical solution, the positioning section increases the connection reliability between the second high-voltage pole and the second mounting seat.

Preferably, the positioning section are a protruding point, a protruding annulation, a wedge block or an agnail part, wherein the side wall of the high-voltage mounting hole is provided with a recessing section which is matched with the positioning section.

Preferably, the first low-voltage assembly includes a first low-voltage pole which possesses an electrical contact end and a wiring end, wherein the electrical contact end is protruded out of a surface opposite to the second mounting seat in the first mounting seat;

The second low-voltage assembly includes a second low-voltage pole which possesses an electrical contact end and a wiring end, wherein the electrical contact end of the second low-voltage pole is parallel with one surface of the second mounting seat opposite to the first mounting seat, and wherein the electrical contact end of the second low-voltage pole is in a separable planar electrical connection with the electrical contact end of the first low-voltage pole.

Preferably, the first mounting seat is provided with a first low-voltage mounting hole which is inserted through the first low-voltage mounting hole;

The first low-voltage assembly also includes a rotating self-cleaning mechanism comprising:

A guiding leg which is located at the outer wall surface of the first low-voltage pole and extended outwards along radial direction of the first low-voltage pole;

A guiding slot which is located at the side wall of the first low-voltage mounting hole, and wherein the guiding leg is configured to slide to the guiding slot, when the guiding leg moves within the guiding slot, and wherein the guiding leg and the guiding slot are matched with each other for limiting the rotating direction of the first low-voltage pole;

The outer wall surface of the first low-voltage pole is sleeved with an elastic component which is used to drive the first low-voltage pole to move along the rotating direction configured by the guiding slot and the guiding leg.

In this technical solution, the guiding leg and the guiding slot limits the rotating direction of the first low-voltage pole by matched with each other, and the elastic component drives the first low-voltage pole to move along the rotating direction configured by the guiding slot, in order to achieve an effect for cleaning the contact surface of the first low-voltage pole and enhance the stability of the electrical contact between the first low-voltage pole and the second low-voltage pole can be enhanced, and thus improve the stability of the electrical contact between the vehicle side electrical connector and the battery side electrical connector.

Preferably, the longitudinal direction of the guiding slot and the central axis of the first low-voltage pole forms an angle, which is 13 to 17 degree.

Preferably, the first low-voltage assembly further includes wires which is configured to be inserted at the wiring end of the first low-voltage pole, wherein the wires located within the first low-voltage mounting hole is spiral.

In this technical solution, the structure stated above ensures the wires to move freely in fixed areas, and the stuck phenomenon will not be taken place.

Preferably, the second mounting seat is provided with a second low-voltage mounting hole which is configured to be inserted through the second low-voltage mounting hole, wherein the outer wall surface of the second low-voltage pole is provided with a positioning section used to limit the movement of the second low-voltage pole relative to the second mounting seat along axial direction of the low-voltage mounting hole.

In this technical solution, the positioning section increases the connection reliability between the second low-voltage pole and the second mounting seat.

Preferably, the positioning section are a protruding point, a protruding annulation, a wedge block or an agnail part, wherein the side wall of the low-voltage mounting hole is provided with a recessing section which is matched with the positioning section.

Preferably:

The first mounting seat comprises:

A floating panel, wherein the floating panel is in a detachable sealing connection with the second mounting seat and the floating panel is provided with a floating panel mounting port;

A first pole mounting plate, wherein the first pole mounting plate is fixed at the floating panel and is throughout the floating panel mounting port, and wherein the first high-voltage assembly and the first low-voltage assembly are configured to be inserted through the first pole mounting plate;

The second mounting seat comprises:

A fixing panel, wherein the fixing panel is in a detachable sealing connection with the floating panel, and wherein the fixing panel is provided with a fixing panel mounting port.

A second pole mounting plate, wherein the second pole mounting plate is fixed at the fixing panel and is throughout the fixing panel mounting port, and wherein the second pole mounting plate is configured to be opposite to the first pole mounting plate, and wherein the second high-voltage assembly and the second low-voltage assembly are configured to be inserted through the second pole mounting plate.

Preferably, the vehicle side electrical connector further comprises a housing used to install on the vehicle body bracket, wherein the housing contains a cavity, wherein the floating panel is floatingly connected with and hermetically connected with the housing, and wherein at least part of the first pole mounting plate is located within the cavity.

Preferably, the housing comprises a floatingly installing section and a plug-in installing section wherein the floatingly installing section is located at the periphery of the front end of the plug-in installing section wherein the plug-in installing section is formed with the cavity, and wherein the floating panel is floatingly connected with and hermitically connected with the floatingly installing section.

Preferably, the floating panel is flexibly connected with the floatingly installing section through a guiding part, wherein the guiding part includes a guiding sleeve and a guiding screw, and wherein the guiding sleeve is installed on the floatingly installing section and the guiding screw is in a threaded connection with the guiding sleeve through the floating panel.

Preferably, the surface of floatingly installing section opposite to the floating panel is provided with a sealing groove, wherein sealing strip is installed within the sealing groove, wherein the floating panel is in contact with the sealing strip.

In this technical solution, installing a sealing strip in the sealing groove can form a sealing structure between the floating panel and the floatingly installing section in order to prevent the external water entering into the inside of the plug-in installing section and thereby increase safety of the high-voltage plug.

Preferably, the vehicle side electrical connector further includes a first sealing ring which is covered the peripheral wall of the floatingly installing section and the whole peripheral wall of the floating panel, and is also in a detachable sealing connection with the fixing panel.

In this technical solution, the first sealing ring may form elastic sealing between the vehicle side electrical connector and the battery side electrical connector, after installing the vehicle side electrical connector and the battery side electrical connector, and thus increase the waterproof ability of the vehicle side electrical connector and the battery side electrical connector maintain a certain amount of activity space when the vehicle body is shaking, such that the stability of the electrical connection between the vehicle side electrical connector and the battery side electrical connector is then increased, and thereby the sealing performance is improved by keeping sealing condition under certain pressure.

Preferably, the first sealing ring comprises:

A ribbon-like annular ring part, which is covered the peripheral wall of the floatingly installing section and the whole peripheral wall of the floating panel.

A first buckling part, which is provided at the inner wall surface of the ribbon-like annular ring part connected with the floatingly installing section, and wherein the first buckling part is connected with the surface of the floatingly installing section away from the floating panel.

A second buckling part, which is provided at the inner wall surface of the ribbon-like annular ring part connected with the floating panel, and wherein the second buckling part is connected with the surface of the floating panel away from the floatingly installing section, and is formed a detachable sealing connection with the fixing panel.

In this technical solution, the first sealing ring wrapped surround the floatingly installing section and the floating panel together and achieved better waterproof performance.

In addition, the floatingly installing section and the floating panel are in fixed connection through the first buckling part and the second buckling part. The stability of the structural connection between the first sealing ring and the floatingly installing section and the floating panel is improved effectively so that preventing the first sealing ring from falling off. And it shows good sealing as well as obvious waterproof performance.

Preferably, surface connecting the first buckling part with the floatingly installing section is provided with a first lock part, wherein the surface of the floatingly installing section away from the floating panel is provided a first neck, and wherein the first lock part is provided in the first neck.

Surface connecting the second buckling part with the floating panel is provided with a second lock part, wherein the surface of the floating panel away from the floatingly installing section is provided with a second neck, and wherein the second lock part is provided in the second neck.

In this technical solution, since the first lock part is configured to lock in the first neck and the second lock part is configured to lock in the second neck, the connection strength of the first sealing ring and the floatingly installing section as well as the first sealing ring and the floating panel can be further enhanced. The stability of the first sealing ring and the floatingly installing section are improved effectively when in connection and in use.

Preferably, the first lock part and the second lock part are all protruding point points, protruding annulations or raised lines.

And/or the first lock part and the second lock part are all T-shape lock part.

Preferably, the battery side electrical connector also includes a second sealing ring, wherein the second sealing ring is sealing connected with the edges of the surface of the fixing panel opposite to the floating panel.

In this technical solution, the second sealing ring is configured to further improve the sealing performance at the connection point between the vehicle side electrical connector and the battery side electrical connector and hence improve the waterproof ability of the vehicle side electrical connector and the battery side electrical connector.

Preferably, the edges of the surface of the fixing panel opposite to the floating panel is provided with a third neck, wherein the third neck is recessed inward along the thickness direction of the fixing panel.

The second sealing ring comprises:

An annular sealing body, which is pressed to be located at the edges of the surface of the fixing panel opposite to the floating panel, and wherein the annular sealing body is in a detachable sealing connection with the second lock part from the first sealing ring.

A lock part, which is extended outwards along the thickness direction of the annular sealing body on the surface of the annular sealing body opposite to the fixing panel, and wherein the lock part is configured to lock in the third neck.

In this technical solution, the lock part is configured to lock in the third neck so that the connection strength between the second sealing ring and the fixing panel is further enhanced. The stability of the second sealing ring and the fixing panel are improved effectively when in connection and in use.

Preferably, the lock part on the second sealing ring are protruding point points, a protruding annulations or raised lines.

And/or the lock part on the second sealing ring are all T-shape lock part.

Preferably:

The vehicle side electrical connector further includes a first locating component, wherein the first locating component is installed on the floating panel and the floating panel is protruded out of one side of the first locating component close to the fixing panel.

The battery side electrical connector further includes a second locating component, wherein the second locating component is installed on the fixing panel, wherein one side of the first locating component close to the fixing panel is provided in the second locating component.

In this technical solution, the set first locating component of the floating panel on the vehicle side electrical connector is located at the set second locating component on the fixed board of the battery side electrical connector. This can prevent damage caused by inaccurate positioning when the first high-voltage pole and the first low-voltage pole from vehicle side electrical connector is contacting with the second high-voltage pole and the second low-voltage pole from battery side electrical connector. Moreover, the coordinating structure of the first locating component and the second locating component can protect the high-voltage pole and low-voltage pole from suffering the affect due to the forces by radial direction after plugged-in.

Preferably, the floating panel is provided with a first locating mounting hole.

The first locating component includes a locating pole, wherein one end of the locating pole away from the fixing panel is embedded and riveted inside the first locating mounting hole, and wherein the floating panel is protruded out of one end of the locating pole close to the fixing panel.

The second locating component further includes a locating sleeve being provided on the fixing panel, wherein one end of the fixing panel close to the locating pole is embedded in the locating sleeve.

In this technical solution, the locating pole set on the floating panel of the vehicle side electrical connector is located at the locating sleeve set on the fixed board of the battery side electrical connector. Therefore, when vehicle side electrical connector is contacting with the battery side electrical connector, the locating pole on the vehicle side electrical connector is locating with the locating sleeve on the battery side electrical connector. Then the first high-voltage pole and the first low-voltage pole from vehicle side electrical connector can contact the corresponding second high-voltage pole and second low-voltage pole from battery side electrical connector to prevent damage caused by inaccurate positioning when the first high-voltage pole and the first low-voltage pole from vehicle side electrical connector is contacting with the second high-voltage pole and the second low-voltage pole from battery side electrical connector. And the cooperating structure of the locating pole and the locating sleeve can protect the high-voltage pole and low-voltage pole from suffering the affect due to the forces by radial direction after plugged-in.

Preferably, the other side of the locating pole is a cone.

In this technical solution, the other side of the locating pole is a cone which is convenient for plugging the locating pole into the locating sleeve on the battery side electrical connector.

Preferably, the fixing panel is provided with a second locating mounting hole, and wherein the locating sleeve is buried and riveted in the second locating mounting hole.

On the basis of common sense in this field, all optimization conditions can be arbitrarily combined to obtain each preferable embodiment.

The positive improved effects of this invention are:

1. In this technical solution, the first high-voltage assembly of the vehicle side electrical connector and the second high-voltage assembly of the battery side electrical connector are in planar electrical connection. When two high-voltage assemblies are suffering the extrusion along their axis, there will be certain floating displacement to eliminate the extrusion force generated so that the first high-voltage assembly and the second high-voltage assembly can be prevented from hard damage, the stability of the electrical contact between the first high-voltage assembly and the second high-voltage assembly can be ensured.

2. The first low-voltage assembly of the vehicle side electrical connector and the second low-voltage assembly of the battery side electrical connector are in planar electrical connection, the contact area of the electrical connection between the low-voltage assembly of the vehicle side electrical connector and the low-voltage assembly of the battery side electrical connector can also be ensured, thereby ensuring the reliability of the electrical connections of the two parties.

3. The first mounting seat and the second mounting seat are in a detachable seal connection, therefore form a seal construction between installed vehicle side electrical connector and installed battery side electrical connector, hence improve the waterproof performance of the vehicle side electrical connector and the battery side electrical connector.

REFERENCE SIGNS

Figure 1:
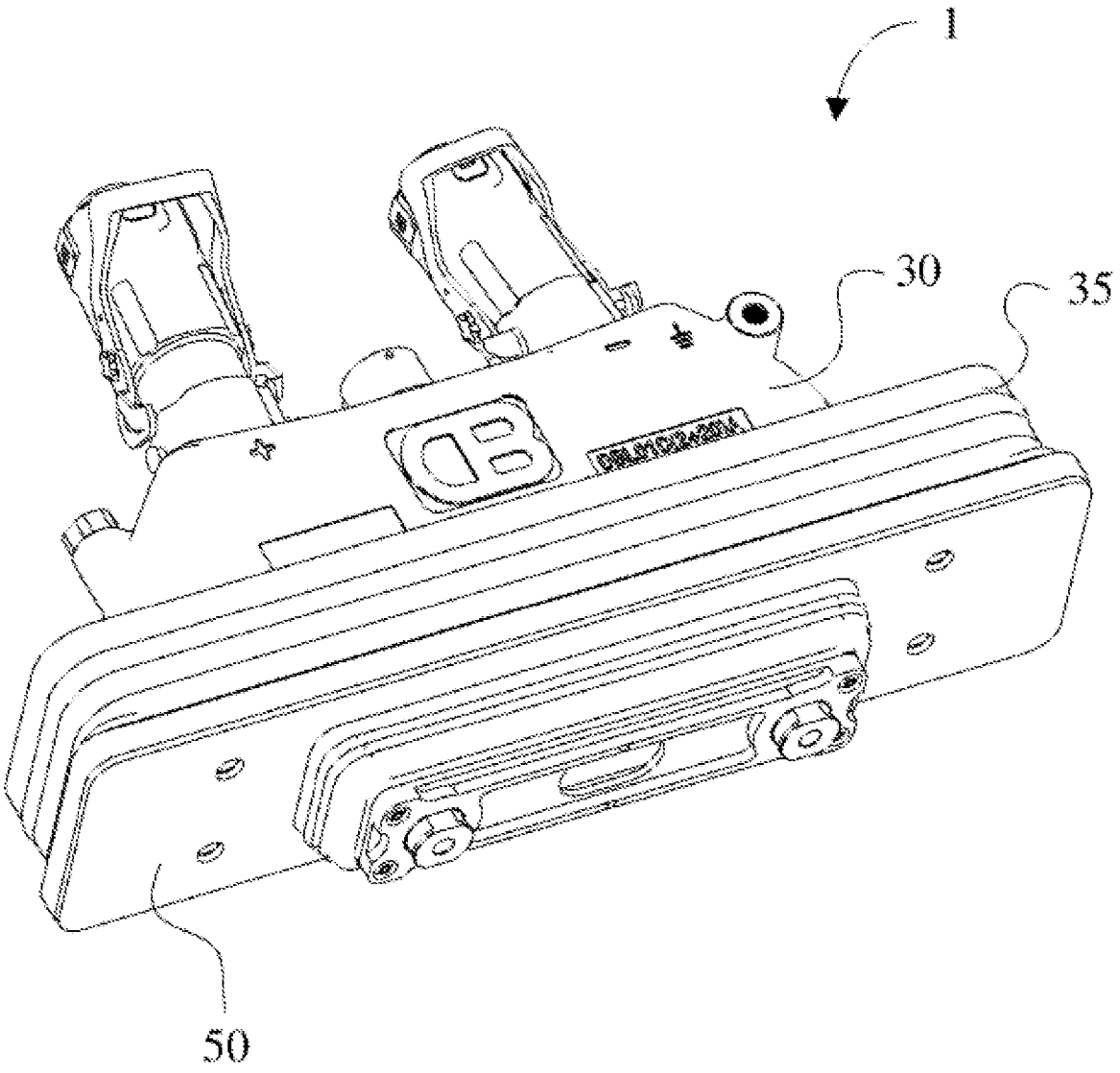
FIG. 1 is a three-dimensional structure of the electrical connection device from a preferable embodiment of this invention.

Electrical connection device 1; Vehicle side electrical connector 3; Housing 30; Floatingly installing section 300; Sealing groove 3001; Sealing strip 3002; First neck 3003; Plug-in installing section 301; Protecting sleeve 3010; Lug boss 3011; Cavity 302; First mounting seat 31; Floating panel 310; Second neck 3100; Floating panel mounting port 3101; First locating mounting hole 3102; First pole mounting plate 311; First high-voltage mounting hole 3110; First low-voltage mounting hole 3111; First high-voltage assembly 32; Outer wall surface 319; First high-voltage pole 320; Groove 3200; Wiring slot 3201; Flexible electrical connector 321; First electrical connector 3210; Flexible cavity 3211; Second electrical connector 3212; Spring 3213; High-voltage plug 322; High-voltage housing 3220; Insulator 3221; Plug pin 3222; Lock catch 3223; Connecting socket base 323; First socket hole 3230; Second socket hole 3231; First conductive elastic component 328; Second conductive elastic component 324; Third conductive elastic component 325; Insulator sleeve 326; Cavity 3260; Fixed sleeve 327; First low-voltage assembly 33; First low-voltage pole 330; Guiding leg 331; Guiding slot 332; Elastic component 333; Wires 334; Limit slot 335; Guiding part 34; Guiding sleeve 340; Guiding screw 341; First sealing ring 35; Ribbon-like annular ring part 350; First buckling part 351; Second buckling part 352; First lock part 353; Second lock part 354; Locating pole 36; Positioning end 360;

Battery side electrical connector 5; Second mounting seat 50; Fixing panel 500; Fixing panel mounting port 5000; Third neck 5001; Second locating mounting hole 5002; Second pole mounting plate 501; Second high-voltage mounting hole 5010; Recessing section 50100; Second low-voltage mounting hole 5011; Recessing section 50110; Second high-voltage assembly 51; Second high-voltage pole 510; Electrical contact end 5100; Positioning section 511; Second low-voltage assembly 52; Second low-voltage pole 520; Electrical contact end 5200; Positioning section 521; Second sealing ring 53; Annular sealing body 530; Third lock part 531; Positioning sleeve 54;

DETAILED DESCRIPTION OF THE PREFERRED EMBODIMENT

The following examples further illustrate the present invention, but the present invention is not limited thereto.

Below presents preferred embodiments of the present invention based on the drawings in order to illustrate the technical schemes of the present invention in detail.

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

Figure 2:
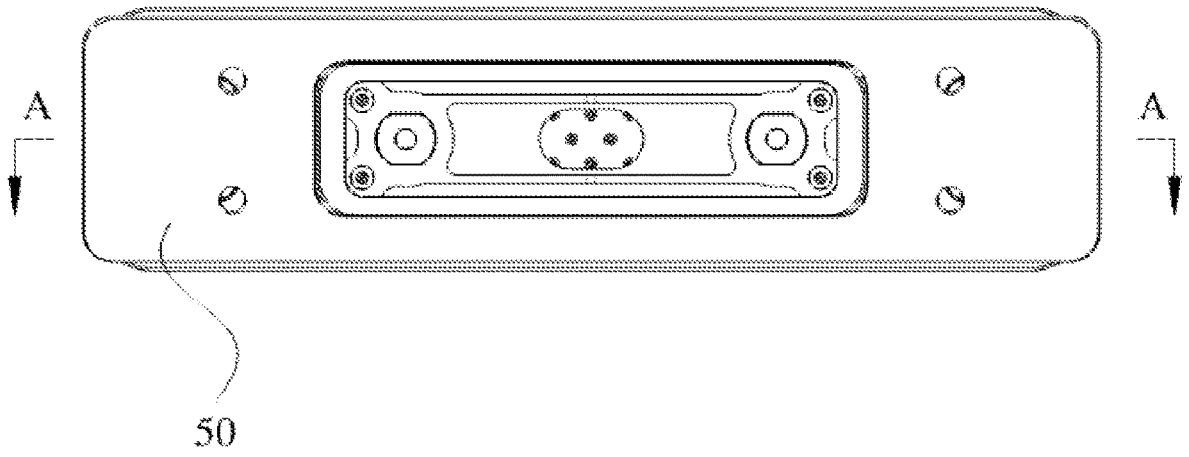
FIG. 2 is a main view structure of the electrical connection device from a preferable embodiment of this invention.
Figure 3:
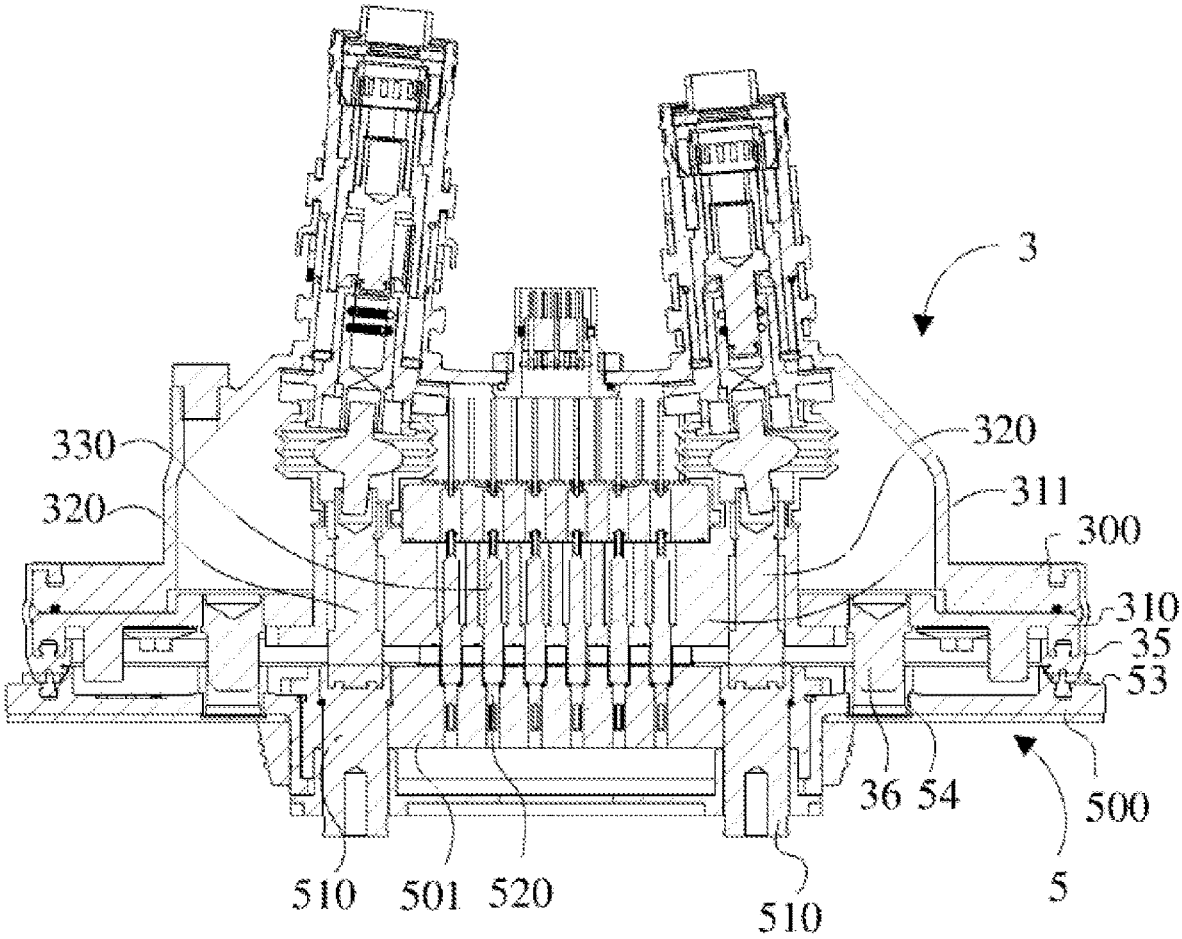
FIG. 3 is a section view structure along A-A in FIG. 2.

FIG. 1-3 illustrates a structure diagram of an electrical connection device 1. The electrical connection device 1 contains a vehicle side electrical connector 3 and a battery side electrical connector 5. To understand with accompanying drawing FIG. 4-5, the vehicle side electrical connector 3 contains a housing 30, a first mounting seat 31, a first high-voltage assembly 32 and a first low-voltage assembly 33. The first mounting seat 31 contains a floating panel 310 and a first pole mounting plate 311. The floating panel 310 has a floating panel mounting port 3101. The first pole mounting plate 311 is detachable fixed at the floating panel 310 and through the floating panel mounting port 3101 by using screw. The first high-voltage assembly 32 and the first low-voltage assembly 33 are located at the first pole mounting plate 311. The first high-voltage assembly 32 and the first low-voltage assembly 33 are set with intervals.

Thereinto, housing 30 is installed on the vehicle body bracket and the housing 30 is integrated pressure casted by using aluminum alloy. The housing 30 contains a floatingly installing section 300 and a plug-in installing section 301. The plug-in installing section has a cavity 302. The floatingly installing section 300 is located at the peripheral in front of the plug-in installing section 301. At least part of the first pole mounting plate 311 is located inside the cavity 302.

Figure 6:
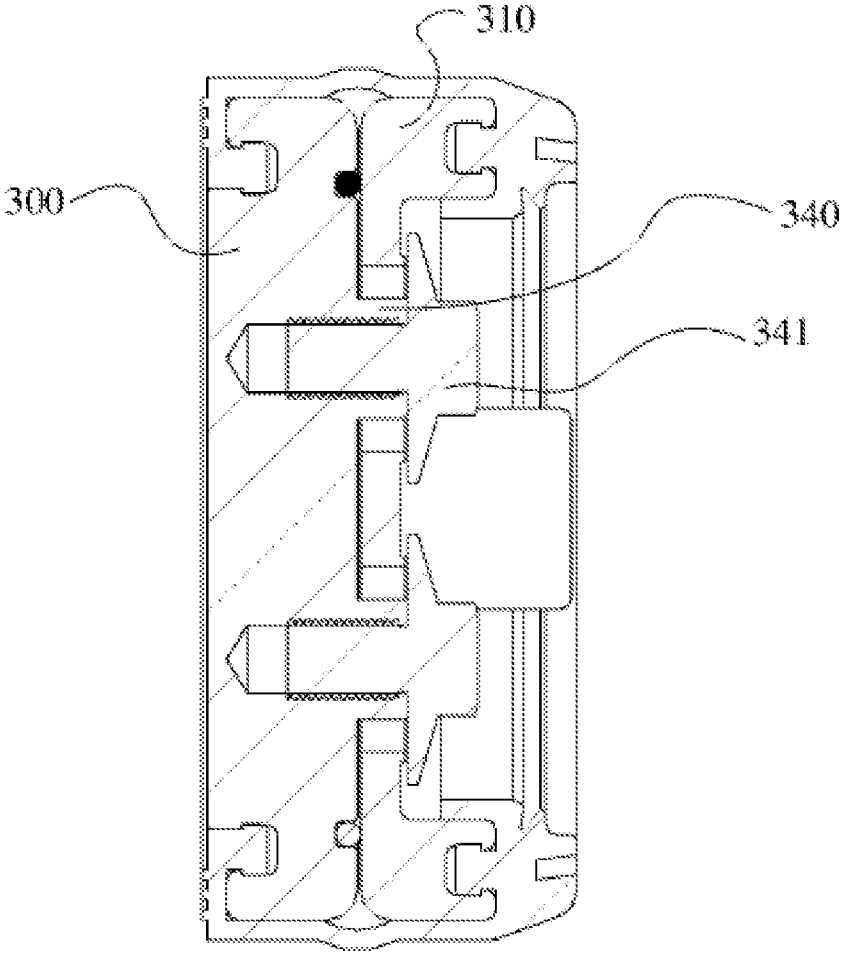
FIG. 6 is a section view structure along C-C in FIG. 4.

To understand with accompanying drawing FIG. 6, the floating panel 310 is floating connected with the floatingly installing section 300. The floating panel 310 is flexible connected with the floatingly installing section 300 through a guiding part 34. The guiding part 34 contains a guiding sleeve 340 and a guiding screw 341. The guiding sleeve 340 is installed on the floatingly installing section 300. The guiding screw 341 is in a threaded connection with the guiding sleeve 340 through the floating panel 310. In this typical embodiment, four guiding parts 34 can be set. Two guiding parts 34 can be set on each of the two sides of the floatingly installing section 300.

Figure 5:
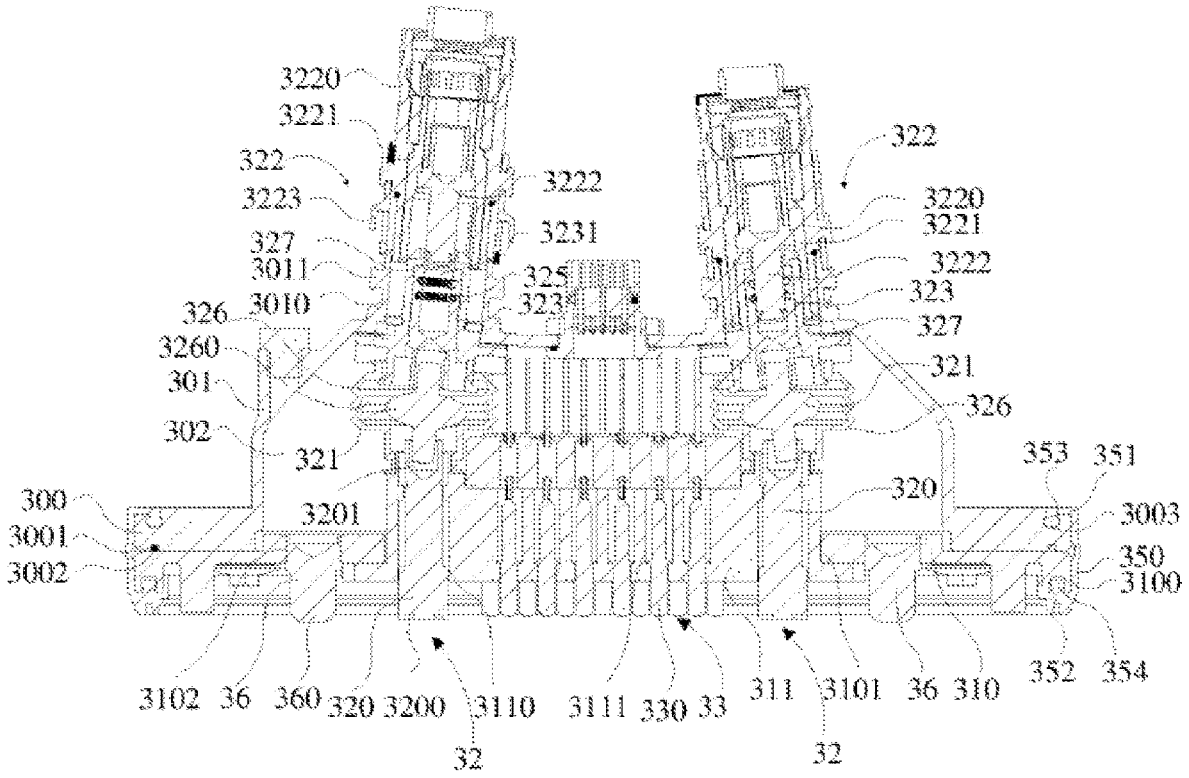
FIG. 5 is a section view structure along B-B in FIG. 4.

As FIG. 5 shown, the floating panel 310 formed a sealing connection with the floatingly installing section 300. The surface of floatingly installing section 300 which is opposite to the floating panel 310 has a sealing groove 3001. A sealing strip 3002 is installed in the sealing groove 3001. The floating panel 310 is in contact with the sealing strip 3002. This can form a sealing structure between the floating panel 310 and the floatingly installing section 300 in order to prevent the external water entering the plug-in installing section 301 and, hence, increase safety of the high-voltage plug 322.

Figure 10:
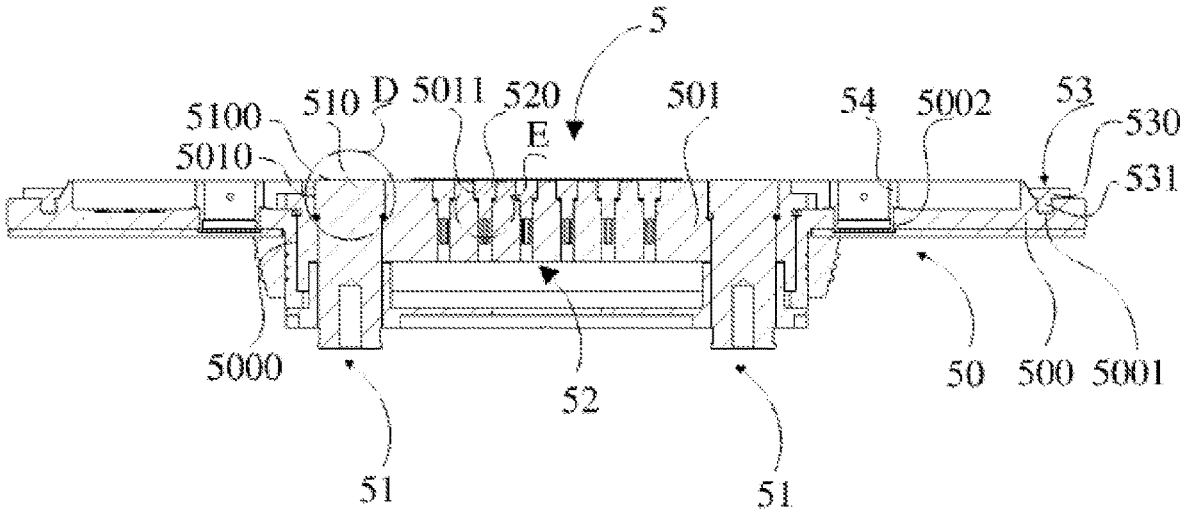
FIG. 10 is the inside structure of the battery side electrical connector on the electrical connection device from a preferable embodiment of this invention.

As FIG. 3 and FIG. 10 shown, the battery side electrical connector 5 comprises a second mounting seat 50, a second high-voltage assembly 51, a second low-voltage assembly 52, the second high-voltage assembly 51 and the second low-voltage assembly 52 are located on the second mounting seat 50, the first high-voltage assembly 32 and the second high-voltage assembly 51 are in a separable planar electrical connection, the first low-voltage assembly 33 and the second low-voltage assembly 52 are in a separable planar electrical connection, the first mounting seat 31 and the second mounting seat 50 are in a detachable seal connection, the first mounting seat 31 is opposite to the second mounting seat 50.

Thereinto, the second mounting seat 50 contains a fixing panel 500 and a second pole mounting plate 501. The fixing panel 500 has a fixing panel mounting port 5000. The second pole mounting plate 501 is fixed at the fixing panel 500 and throughout the fixing panel mounting port 5000. The second high-voltage assembly 51 and the second low-voltage assembly 52 are located at the second pole mounting plate 501. The fixing panel 500 is in a detachable sealing connection with the floating panel 310 and the second pole mounting plate 501 is opposite to the first pole mounting plate 311.

In this typical embodiment, the first high-voltage assembly 32 of the vehicle side electrical connector 3 and the second high-voltage assembly 51 of the battery side electrical connector are in planar electrical connection. When two high-voltage assemblies are suffering the extrusion along their axis, there will be certain floating displacement to eliminate the extrusion force generated so that the first high-voltage assembly 32 and the second high-voltage assembly 51 can be prevented from hard damage, the stability of the electrical contact between the first high-voltage assembly 32 and the second high-voltage assembly 51 can be ensured.

The first low-voltage assembly 33 of the vehicle side electrical connector 3 and the second low-voltage assembly 52 of the battery side electrical connector 5 are in planar electrical connection, the contact area of the electrical connection between the low-voltage assembly of the vehicle side electrical connector 3 and the low-voltage assembly of the battery side electrical connector 5 can also be ensured, thereby ensuring the reliability of the electrical connections of the two parties.

The floating panel 310 of the first mounting seat 31 and the fixing panel 500 of the second mounting seat 50 are in a detachable seal connection, therefore form a seal construction between installed vehicle side electrical connector 3 and installed battery side electrical connector 5, hence improve the waterproof performance of the vehicle side electrical connector 3 and the battery side electrical connector 5.

Figure 4:
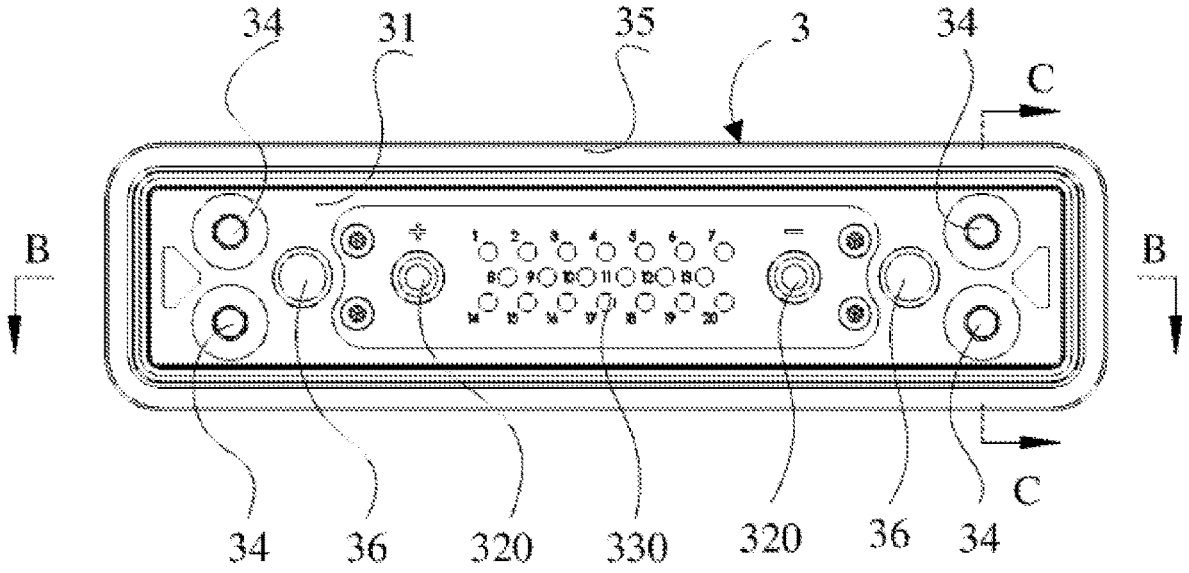
FIG. 4 is a main view structure of the vehicle side electrical connector on the electrical connection device from a preferable embodiment of this invention.

As FIG. 3-5 shown, the first high-voltage assembly 32 comprises a first high-voltage pole 320. The first pole mounting plate 311 has a first high-voltage mounting hole 3110. The first high-voltage pole 320 is located through the first high-voltage mounting hole 3110 and sliding located in the first high-voltage mounting hole 3110 along the axial direction of the first high-voltage mounting hole 3110. The outer wall surface of the first high-voltage pole 320 has elastic components (not shown). Elastic components are located in the first high-voltage mounting hole 3110. One side of the elastic component reaches the first high-voltage mounting hole 3110 and the other side of the elastic component reaches the first high-voltage pole 320.

The outer wall surface of the first high-voltage pole 320 has elastic components. After the first high-voltage pole 320 contacting the second high-voltage pole 510 from battery side electrical connector 5, certain elasticity is kept. This can improve the contact performance of the contact points and make the first high-voltage pole 320 can stand the extrusion force from vertical direction. Since the first high-voltage pole 320 can stand the extrusion force from the axial direction of the first high-voltage pole 320 and prevent from hard damage, the life time of the first high-voltage pole 320 is increased.

The first high-voltage pole 320 contains an electrical contact end and a wiring end. One side of the first pole mounting plate 311 opposite to the second pole mounting plate 501 on the second mounting seat 50 from the first mounting seat 31 is stood out by the electrical contact end of the first high-voltage pole 320. And the surface of the electrical contact end of the first high-voltage pole 320 has a groove 3200. The groove 3200 recessed inward along the axis direction of the first high-voltage pole 320. A first conductive elastic component (not shown) is embedded in the groove 3200. The first conductive elastic component is stood out from the surface of the electrical contact end of the first high-voltage pole.

Figure 13:
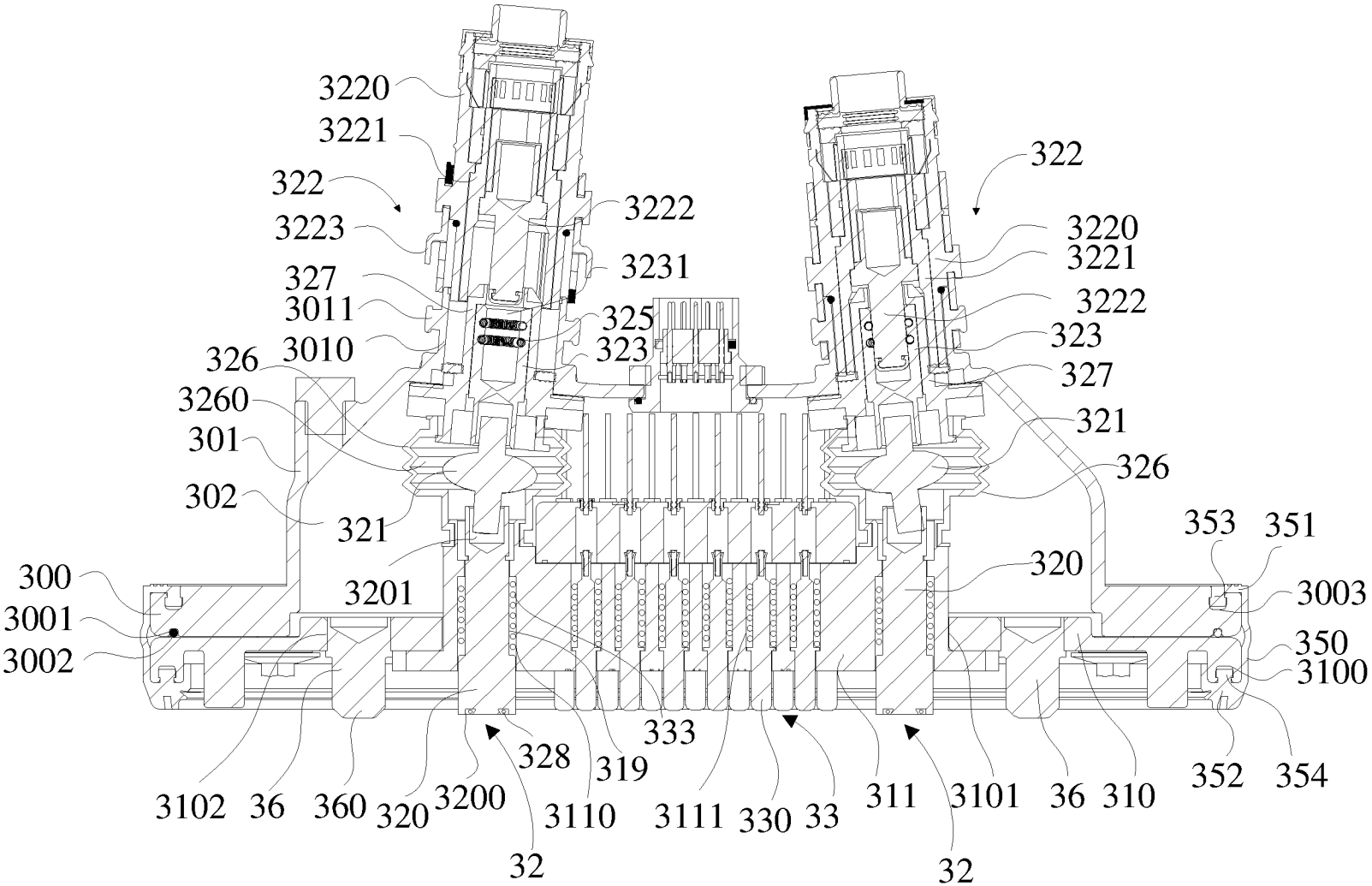
FIG. 13 is a section view structure along B-B in FIG. 4 with elastic components and first conductive elastic components shown.

As FIG. 13 shown, elastic components 333 are shown on the outer wall surface 319 of the first high-voltage pole 320 and in the first low-voltage mounting hole 3111. Also, the first conductive elastic components are shown as being embedded in each of the groove 3200.

As FIG. 3 and FIG. 10 shown, the second high-voltage assembly 51 comprises a second high-voltage pole 510. The second high-voltage pole 510 contains an electrical contact end and a wiring end. The electrical contact end 5100 on the second high-voltage pole 510 is parallel with one side of the second pole mounting plate 501 which is opposite to the first pole mounting plate 311. The electrical contact end 5100 on the second high-voltage pole 510 is in a separable planar electrical connection with the electrical contact end on the first high-voltage pole 320 through the first conductive elastic component. The first conductive elastic component is located between the groove 3200 and the electrical contact end 5100 on the second high-voltage pole 510.

A groove 3200 is set at the electrical contact end on the first high-voltage pole 320 of the vehicle side electrical connector 3. A first conductive elastic component is located in the groove 3200. The first conductive elastic component can perform elastic deformation when squeezed by the battery side electrical connector 5. This elastic deformation can eliminate the extrusion force and keep good contact, thereby achieve high-voltage floating connection between the vehicle side electrical connector 3 and the battery side electrical connector 5 to accommodate the vibrating vehicle body condition and maintain stable electrical connection between the two.

Figure 11:
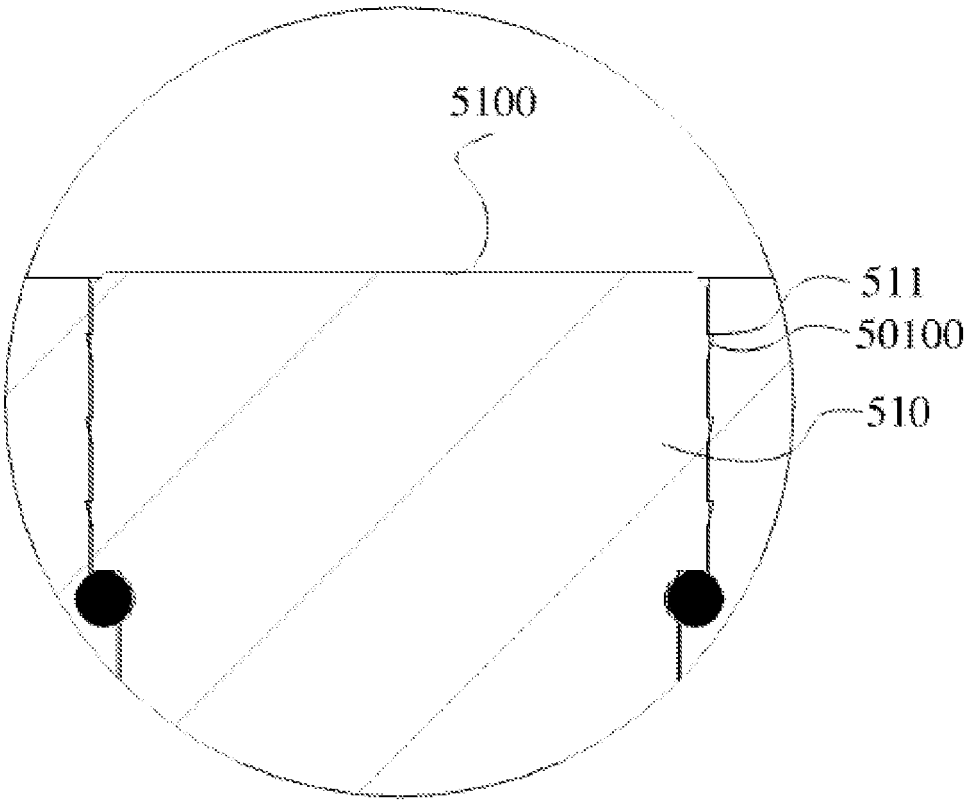
FIG. 11 is an enlarged structure diagram of part D in FIG. 10.

To understand with accompanying drawing FIG. 11, the second pole mounting plate 501 on the second mounting seat 50 has a second high-voltage mounting hole 5010. The second high-voltage pole 510 is located through the second high-voltage mounting hole 5010. The outer wall surface of the second high-voltage pole 510 has a positioning section 511. The positioning section 511 is used to restrict the movement of the second high-voltage pole 510 moving relative to the second pole mounting plate 501 along the axial direction of the second high-voltage mounting hole 5010. This setting increased the connection reliability between the second high-voltage pole 510 and the second pole mounting plate 501 on the second mounting seat 50.

Preferably, the positioning section 511 can be a protruding point, a protruding annulation, a wedge block or an agnail part. The side wall of the second high-voltage mounting hole 5010 has a recessing section 50100 which matched with the positioning section.

As FIG. 5 shown, the groove 3200 on the first high-voltage pole 320 is an annular groove. The axis of the annular groove is in overlapped with the axis of the first high-voltage pole 320. The first conductive elastic component can be a conductive spring. The contact surface of the electrical contact end 5100 on both the first high-voltage pole 320 and the second high-voltage pole 510 are flat surfaces. The contact area between the first high-voltage pole 320 of vehicle side electrical connector 3 and the second high-voltage pole 510 of battery side electrical connector 5 are ensured and then the reliability of electrical connection between the two is ensured.

As FIG. 5 shown, the first high-voltage assembly 32 also contains a flexible electrical connector 321 and a high-voltage plug 322. One end of the flexible electrical connector 321 is in a planar electrical connection with the wiring end of the first high-voltage pole 320. The other end of the flexible electrical connector 321 is in a planar electrical connection with the high-voltage plug 322.

In this embodiment, both end of the first high-voltage 320 pole are in planar electrical connections through the flexible electrical connector 321. This prevents abnormal conditions such as electrical connection failure or overburning caused by loose connection. And increases the stability of the electrical connection between the vehicle side electrical connector 3 and the battery side electrical connector 5. In addition, the high-voltage plug 322 is in a planar electrical connection with the first high-voltage pole 320 through the flexible electrical connector 321. This increases the stability of the electrical connection between the first high-voltage pole 320 and the high-voltage plug 322 when in axial movement and radial rotation. Thus, increasing the safety and electrical conductivity of the electrical connection device 1.

Besides, the wiring end of the first high-voltage pole 320 has a wiring slot 3201. The wiring slot 3201 is recessed inward along the axis direction of the first high-voltage pole 320. One side of the flexible electrical connector 321 is configured to be pressed to connect with the wiring slot 3201 and a second conductive elastic component 324 is pressed between the inner walls of the wiring slot 3201. The stability of the electrical connection between the first high-voltage pole 320 and the flexible electrical connector 321 is enhanced by achieving the floating connection between the first high-voltage pole 320 and the flexible electrical connector 321 through the second conductive elastic component 324.

Figure 7:
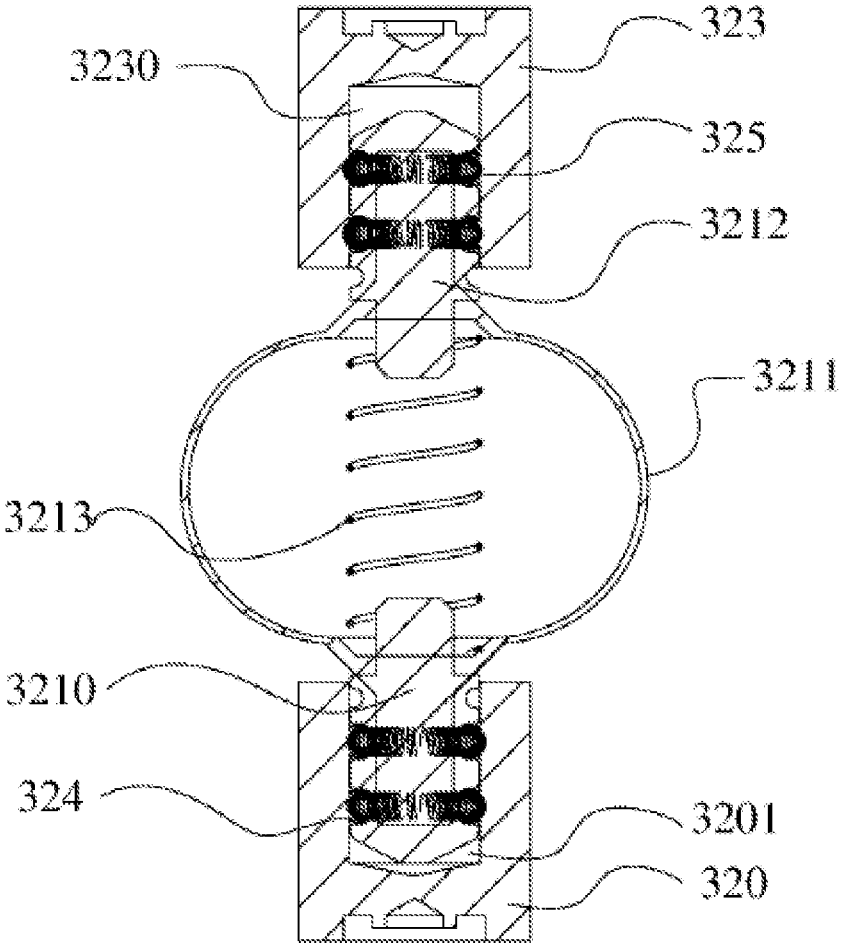
FIG. 7 is the structure of the flexible electrical connector of vehicle side electrical connector on the electrical connection device from a preferable embodiment of this invention.

To understand with accompanying drawing FIG. 7, the flexible electrical connector 321 contains a first electrical connector 3210, a flexible cavity 3211, a second electrical connector 3212 and a spring 3213. One side of the first electrical connector 3210 is configured to be pressed to connect with the wiring slot 3201 and a second conductive elastic component 324 is pressed between the inner walls of the wiring slot 3201.

One side of the flexible cavity 3211 is crimping or welding with the other side of the first electrical connector 3210. And the flexible cavity 3211 is located outside the first high-voltage pole 320 and the high-voltage plug 322. The flexible cavity is made of flexible conductive material. One side of the second electrical connector 3212 is crimping or welding with the other side of the flexible cavity 3211. The other side of the second electrical connector 3212 is in a planar electrical connection with the high-voltage plug 322. The spring 3213 is located inside the flexible cavity 3211, and two sides of the spring 3213 are connected with the first electrical connector 3210 and the second electrical connector 3212 respectively. When the flexible electrical connector 321 is in use, the flexible cavity 3211 can be stretched, compressed or twisted in order to adapt the relative displacement change in axial, radial and all directions between the structural connections. This prevents poor conductivity caused by relative displacement change and increased the stability of the electrical connection of the vehicle side electrical connector 3 dramatically.

Besides, the flexible cavity 3211 is crimping or welding with the first electrical connector 3210 and the second electrical connector 3212. This enhanced the structural connection strength of the flexible electrical connector 321 and ensured the stability of the electrical connection of the flexible electrical connector 321. The spring 3213 can effectively increases the structural strength of the flexible electrical connector 321, hence two sides of the flexible cavity 3211 can also ensure the electrical connection performance of the flexible electrical connector 321 during relative displacement change. And the spring 3213 is conductive and further improving the stability of the electrical connection between the first electrical connector 3210 and the second electrical connector 3212.

As FIG. 5 and FIG. 7 shown, high-voltage plug 322 is set at the plug-in installing section 301 on the housing 30 which located outside the cavity 302. The outer wall surfaces of the end which is away from the floatingly installing section 300 in the plug-in installing section 301 has a protecting sleeve 3010. The outer wall surfaces of the protecting sleeve 3010 has a lug boss 3011.

The high-voltage plug 322 contains a high-voltage housing 3220, an insulator 3221 and a plug pin 3222. The insulator 3221 is located and fixed inside the high-voltage housing 3220. The plug pin 3222 is located and fixed inside the insulator 3221. The other side of the second electrical connector 3212 of the flexible electrical connector 321 is floating connected with the plug pin 3222 on the high-voltage plug 322 through connecting socket base 323. One side of the connecting socket base 323 has a first socket hole 3230. The other side of the connecting socket base 323 has a second socket hole 3231. The other side of the second electrical connector 3212 of the flexible electrical connector 321 is crimping inside the first socket hole 3230. The plug pin 3222 is in a floating connection with the second socket hole 3231. And also a third conductive elastic component 325 is crimping located in the second electrical connector 3212 of the flexible electrical connector 321 and the inner wall of the first socket hole 3230 as well as the plug pin 3222 and the inner wall of the second socket hole 3231. Preferably, the third conductive elastic component 325 is a conductive spring.

In the vehicle side electrical connector 3, the outer surfaces on one side of the plug-in installing section 301 which is away from the floatingly installing section 300 has a protecting sleeve 3010. The outer wall surfaces of the protecting sleeve 3010 has a lug boss 3011. One side of the high-voltage housing 3220 is plugged locating in the protecting sleeve 3010. And the outer wall surfaces of the high-voltage housing 3220 is rotating connected with a lock catch 3223. The lock catch is located on the lug boss. This can conveniently and reliably fix the high-voltage plug 322 on the protecting sleeve 3010 on the plug-in installing section 301. And easily detaching the high-voltage plug 322 from the protecting sleeve 3010 on the plug-in installing section 301.

Besides, the outer wall surfaces of one side of the high-voltage housing 3220 is in a sealing connection with the inner wall surfaces of the protecting sleeve 3010. Therefore, high-voltage plug 322 can form a sealing structure with the protecting sleeve 3010 on the plug-in installing section 301 in order to prevent external water entering the plug-in installing section 301 and the inside of the high-voltage plug 322. The safety of the high-voltage plug 322 is increased.

In addition, the vehicle side electrical connector 3 also contains an insulator sleeve 326. One side of the insulator sleeve 326 is connected with the first pole mounting plate 311. The other side of the insulator sleeve 326 is connected with a fixed sleeve 327. The fixed sleeve 327 is connected within the plug-in installing section 310 on the housing 30. And at least part of the fixed sleeve 327 is located in the protecting sleeve 3010 on the housing 30. The connecting socket base 323 is located in the fixed sleeve 327. In this embodiment, high-voltage housing 3220 on high-voltage plug 322 and the bottom of insulator 3221 is set between the outer wall surface of the fixed sleeve 327 and the inner wall surface of the protecting sleeve 3010.

Furthermore, the insulator sleeve 326 has a cavity 3260. The flexible electrical connector 321 is located in the cavity 3260. The insulator sleeve 326 plays a protective role for the flexible electrical connector 321 and provides a good insulation and sealing effect for the flexible electrical connector 321. Hence increases the safety and stability of the vehicle side electrical connector 3.

As FIG. 3 and FIG. 5 shown, the first low-voltage assembly 33 contains a first low-voltage pole 330. The first pole mounting plate 311 on the first mounting seat 31 has a first low-voltage mounting hole 3111. The first low-voltage pole 330 is located at the first low-voltage mounting hole 3111. The first low-voltage pole 330 has an electrical contact end and a wiring end. One side opposite to the second pole mounting plate 501 on the second mounting seat 50 from the first pole mounting plate 311 on the first mounting seat 31 is stood out by the electrical contact end.

Figure 8:
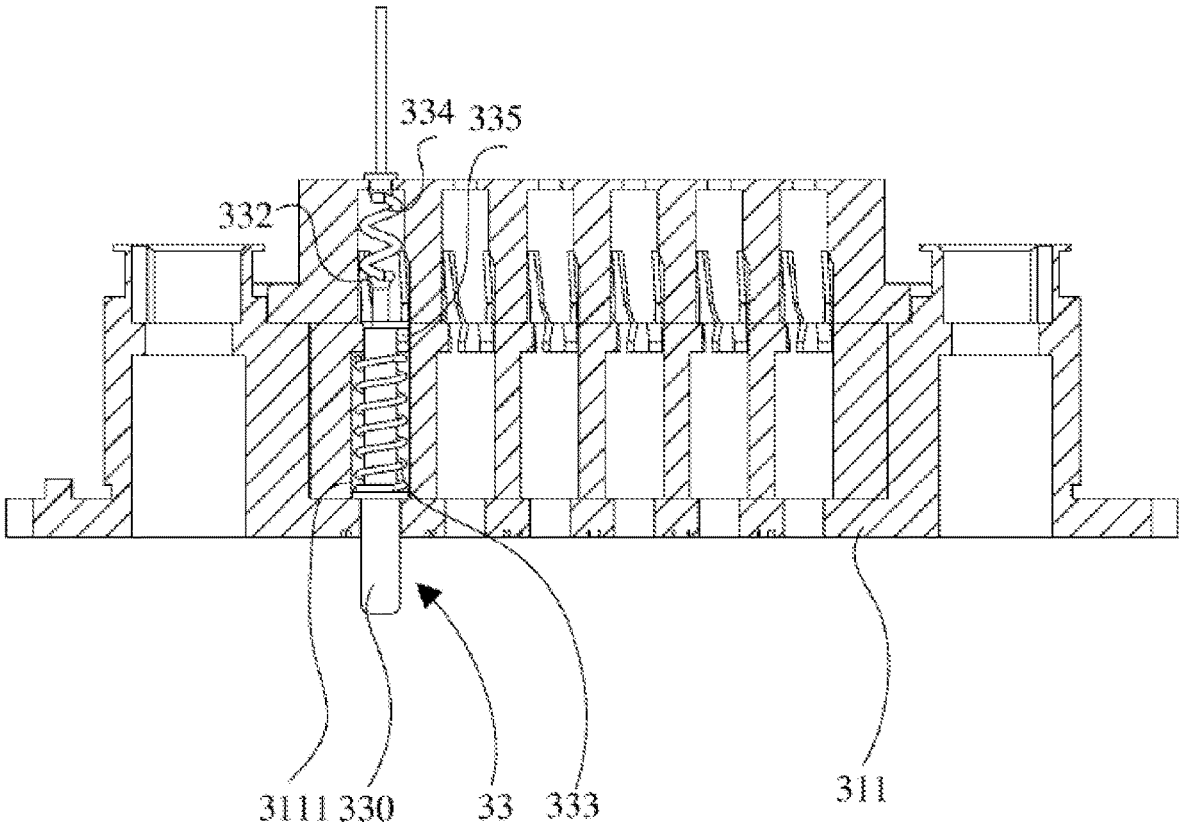
FIG. 8 is the structure of the low-voltage assembly of vehicle side electrical connector on the electrical connection device from a preferable embodiment of this invention.
Figure 9:
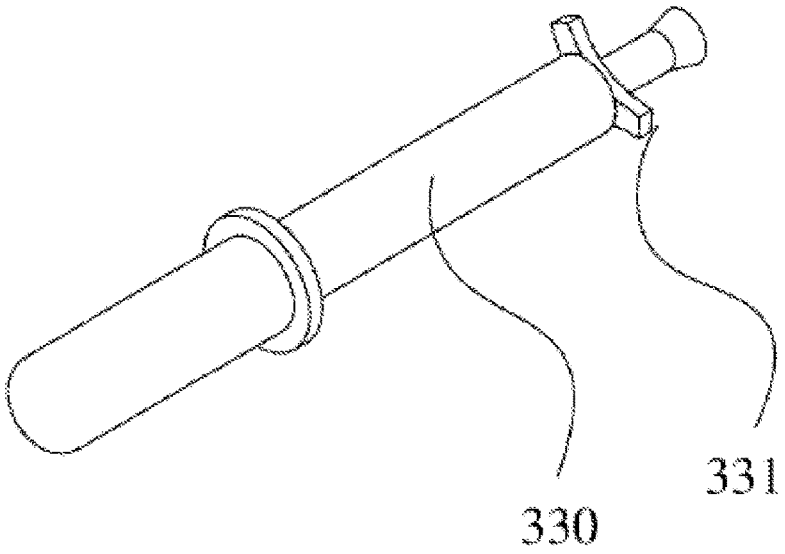
FIG. 9 is the structure of the low-voltage pole of vehicle side electrical connector on the electrical connection device from a preferable embodiment of this invention.

To understand with accompanying drawing FIG. 8-9, the first low-voltage assembly 33 also contains a rotating self-cleaning mechanism and wires 334. The rotating self-cleaning mechanism contains a guiding leg 331 and a guiding slot 332. The guiding leg 331 is located at the outer wall surface of the first low-voltage pole 330 and extended outwards along the radial direction of the first low-voltage pole 330. The guiding slot 332 is located at the side wall of the first low-voltage mounting hole 3111.

When the guiding leg 331 moving to the guiding slot 332, the guiding leg 331 slides located at the guiding slot 332. The guiding leg 331 and the guiding slot 332 are matched for restricting the rotating direction of the first low-voltage pole 330. The outer wall surface of the first low-voltage pole 330 has an elastic component. The elastic component 333 is used to bring the first low-voltage pole 330 moving along the rotating direction set by the guiding slot 332 and the guiding leg 331.

By using the guiding leg 331 and the guiding slot 332 to restrict the rotating direction of the first low-voltage pole 330 and the elastic component 333 to bring the first low-voltage pole 330 moving along the rotating direction set by the guiding slot 332, the contact surface of the first low-voltage pole 330 can be cleaned as a result. The stability of the electrical contact between the first low-voltage pole 330 and the second low-voltage pole 520 can be enhanced. And the stability of the electrical contact between the vehicle side electrical connector 3 and the battery side electrical connector 5 can be further improved.

Preferably, the longitudinal direction of the guiding slot 332 and the central axis of the first low-voltage pole 330 forms an angle. This angle is between 13 to 17 degrees. Preferably, this angle is 15 degrees. Therefore, this angle can be used to limit the rotating direction of the first low-voltage pole 330 in order to fulfill the purpose of cleaning the contact area of the first low-voltage pole 330.

Moreover, one end of the wire 334 is located at the wiring end of the first low-voltage pole 330. The shape of the wires 334 located inside the first low-voltage mounting hole 3111 is spiral. Using the structure stated above, it can ensure the wires 334 to move freely in fixed areas and the wires will not get stuck.

Further preferably, the amount of guiding leg 331 and guiding slot 332 can be any number. Some guiding feet 331 is set along the first low-voltage pole 330 with intervals. Some guiding slots 332 is set along the first low-voltage mounting hole 3111 with intervals. The guiding slots 332 and the guiding feet 331 are in one-to one matched setting. In this embodiment, guiding feet 331 and guiding slots 332 are three each. By setting the position and the number of guiding feet 331 as three, the rotating motion of the first low-voltage pole 330 is much more stable. In other embodiments, the number of guiding feet 331 and guiding slots 332 can be two, four or any other number. These guiding feet 331 are set evenly along the first low-voltage pole 330 with intervals.

The side wall of the mounting hole has a limit slot 335. One side of the limit slot 335 is adjacent and in connection with the guiding slot 332. The guiding feet 331 is located in the limit slot 335. By setting a limit slot 335, it can limit the guiding feet 331 under standard condition to make sure guiding feet 331 will return and remain at the same fixed position after reciprocating rotational movement in order to increase the accuracy of the low-voltage pole in each reciprocating rotational movement.

When the second low-voltage pole 520 on the battery side electrical connector 5 is connecting with the first low-voltage pole 330 on the vehicle side electrical connector 3. Due to electrical connection, force is generated and transferred along the contact surface towards the first low-voltage pole 330. The force is compressing the elastic component which is in the initial state. And bringing the first low-voltage pole 330 move along the direction of this force. By setting a guiding leg 331 on the first low-voltage pole 330 and setting a guiding slot 332 on the side wall of the first low-voltage mounting hole 3111 corresponding to the guiding leg 331. The set direction of guiding slot 332 and guiding feet 331 can cooperate with guiding slot 332 to lead and limit the first low-voltage pole 330 move and rotate at the same time. On the other hand, when this force is not applied, the elastic component 333 is released and will recover to its initial state, during the recover, the elastic component brings the first low-voltage pole 330 to move opposite against the set rotating direction of guiding slot 3. And thus finish reciprocating rotation movement to generate friction on the contact surface of the first low-voltage pole 330. Hence achieve the effect of cleaning the contact surface of the first low-voltage pole 330 and increases the stability of the electrical contact of the first low-voltage pole 330.

As FIG. 3 and FIG. 10 shown, the second low-voltage assembly 52 contains a second low-voltage pole 520. The second pole mounting plate 501 on the second mounting seat 50 has a second low-voltage mounting hole 5011. The second low-voltage pole 520 is located at the second low-voltage mounting hole 5011.

The second low-voltage pole 520 contains an electrical contact end and a wiring end. The electrical contact end 5200 on the second low-voltage pole 520 is parallel with one side of the second pole mounting plate 501 on the second mounting seat 50 which is opposite to the first pole mounting plate 311 on the first mounting seat 31. The electrical contact end 5200 on the second low-voltage pole 520 is in a separable planar electrical connection with the electrical contact end on the first low-voltage pole 330.

Figure 12:
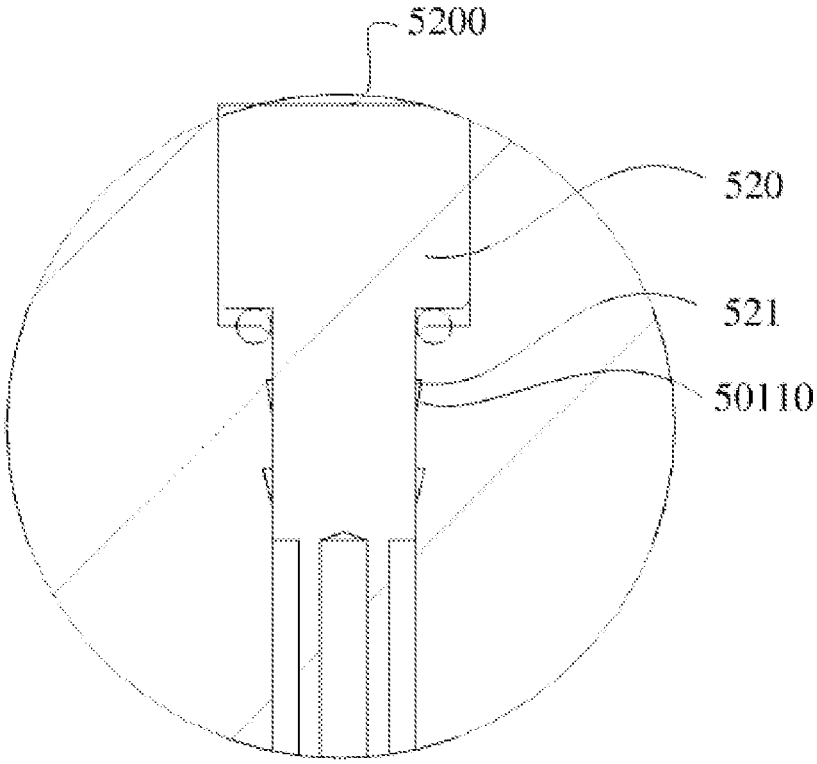
FIG. 12 is an enlarged structure diagram of part E in FIG. 10.

To understand with accompanying drawing FIG. 12, the outer wall surface of the second high-voltage pole 520 has a positioning section 521. The positioning section 521 is used to restrict the movement of the second high-voltage pole 520 moving relative to the second pole mounting plate 501 of the second mounting seat 50 along the axial direction of the high-voltage mounting hole 5011. This setting increased the connection stability between the second low-voltage pole 520 and the second pole mounting plate 501 on the second mounting seat 50.

Preferably, the positioning section 521 can be a protruding point, a protruding annulation, a wedge block or an agnail part. The side wall of the high-voltage mounting hole 5011 has a recessing section 50110 which matched with the positioning section.

In one embodiment of this present invention, the first high-voltage pole 320 can be set as two and located at two sides of the first pole mounting plate 311. The first low-voltage pole 330 can be set as several amount and distribute between two first high-voltage poles 320. The second high-voltage pole 510 can be set as two and located at two sides of the second pole mounting plate 501. The second low-voltage pole 520 can be set as several amount and distribute between two second high-voltage poles 510.

As FIG. 3 and FIG. 5 shown, the vehicle side electrical connector 3 also contains a first sealing ring 35. The first sealing ring 35 covered the peripheral wall of the floatingly installing section 300 and the whole peripheral wall of the floating panel 310. The first sealing ring is also in a detachable sealing connection with the fixing panel 500. The first sealing ring can be set between the installed vehicle side electrical connector 3 and the installed battery side electrical connector 5 to form elastic sealing. Thus waterproof ability of the vehicle side electrical connector 3 and the battery side electrical connector 5 are increased. Also, a certain amount of flexibility is kept when the vehicle body is shaking, the stability of the electrical connection between the vehicle side electrical connector 3 and the battery side electrical connector 5 is then increased. Sealing performance is improved by keeping sealing condition under certain pressure.

Thereinto, the first sealing ring 35 contains a ribbon-like annular ring part 350, a first buckling part 351 and a second buckling part 352. The ribbon-like annular ring part 350 covered the peripheral wall of the floatingly installing section 300 and the whole peripheral wall of the floating panel 310. The first sealing ring 35 wrapped surround the floatingly installing section 300 and the floating panel 310 together and achieved better waterproof performance.

Besides, the first buckling part 351 is set at the inner wall surface of the ribbon-like annular ring part 350 which is connected with the floatingly installing section 300 and the first buckling part 351 is connected with the surface of the floatingly installing section 300 which is away from the floating panel 310. The second buckling part 352 is set at the inner wall surface of the ribbon-like annular ring part 350 which is connected with the floating panel 310 and the second buckling part 352 is connected with the surface of the floating panel 310 which is away from the floatingly installing section 300. Then formed a detachable sealing connection with the fixing panel 500. The floatingly installing section 300 and the floating panel 310 are in fixed connection through the first buckling part 351 and the second buckling part 352. The stability of the structural connection between the first sealing ring 35 and the floatingly installing section 300 and the floating panel 310 is improved effectively so that preventing the first sealing ring 35 from falling off. And it shows good sealing as well as obvious waterproof performance.

In addition, the surface of the first buckling part 351 which is connected with the floatingly installing section 300 has a first lock part 353. The surface of the floatingly installing section 300 which is away from the floating panel 310 has a first neck 3003. The first lock part 353 is configured to lock in the first neck 3003. The surface of the second buckling part 352 which is connected with the floating panel 310 has a second lock part 354. The surface of the floating panel 310 which is away from the floatingly installing section 300 has a second neck 3100. The second lock part 354 is configured to lock in the second neck 3100.

In this embodiment, the first lock part 353 is configured to lock in the first neck 3003 and the second lock part 354 is configured to lock in the second neck 3100, the connection strength of the first sealing ring 35 and the floatingly installing section 300 as well as the first sealing ring 35 and the floating panel 310 can be further enhanced. The stability of the first sealing ring 35 and the floatingly installing section 300 are improved effectively when in connection and in use.

Preferably, the first lock part 353 and the second lock part 354 are all protruding point points, protruding annulations or raised lines. Further preferably, the first lock part 353 and the second lock part 354 are all T-shape lock part.

As FIG. 3 and FIG. 10 shown, the battery side electrical connector 5 also contains a second sealing ring 53. The second sealing ring 53 is sealing connected with the edges of the surface of the fixing panel 500 which is opposite to the floating panel 310. The second sealing ring is configured to further improve the sealing performance at the connection point between the vehicle side electrical connector 3 and the battery side electrical connector 5 and hence improve the waterproof ability of the vehicle side electrical connector 3 and the battery side electrical connector 5.

Moreover, the edges of the surface of the fixing panel 500 which is opposite to the floating panel 310 has a third neck 5001. The third neck 5001 recessed inward along the thickness direction of the fixing panel 500. The second sealing ring 53 contains an annular sealing body 530 and A third lock part 531. The annular sealing body 530 is located at the edges of the surface of the fixing panel 500 which is opposite to the floating panel 310. And the annular sealing body 530 is in a detachable sealing connection with the second lock part 352 from the first sealing ring 35.

The third lock part 531 extended outwards along the thickness direction of the annular sealing body 530 on the surface of the annular sealing body 530 which is opposite to the fixing panel 500. The third lock part 531 is configured to lock in the third neck 5001 so that the connection strength between the second sealing ring 53 and the fixing panel 500 is further enhanced. The stability of the second sealing ring 53 and the fixing panel 500 are improved effectively when in connection and in use.

Preferably, the third lock part 531 on the second sealing ring 53 are protruding point points, a protruding annulations or raised lines. Further preferably, the third lock part 531 can be T-shape lock part.

As FIG. 3 and FIG. 5 shown, the vehicle side electrical connector 3 also contains a locating pole 36. The floating panel 310 has a first locating mounting hole 3102. One side of the locating pole 36 which is away from the fixing panel 500 is located and riveting inside the first locating mounting hole 3102. The floating panel 310 is stood out from one side of the locating pole 36 which is close to the fixing panel 500. Preferably, the other side of the locating pole 36 is called positioning end and showed a cone shape which is convenient for plugging the locating pole 36 into the locating sleeve 54 on the battery side electrical connector 5.

The battery side electrical connector 5 also contains a locating sleeve 54. The locating sleeve 54 is set on the fixing panel 500. The fixing panel 500 has a second locating mounting hole 5002. The locating sleeve 54 is buried and riveted in the second locating mounting hole 5002. One side of the fixing panel 500 close to the locating pole 36 is located in the locating sleeve 54.

The locating pole 36 set on the floating panel 310 of the vehicle side electrical connector 3 is located at the locating sleeve 54 set on the fixed board of the battery side electrical connector 5. Therefore, when vehicle side electrical connector 3 is contacting with the battery side electrical connector 5, the locating pole 36 on the vehicle side electrical connector 3 is locating with the locating sleeve 54 on the battery side electrical connector 5. Then the first high-voltage pole 320 and the first low-voltage pole 330 from vehicle side electrical connector 3 can contact the corresponding second high-voltage pole 510 and second low-voltage pole 520 from battery side electrical connector 5 to prevent damage caused by inaccurate positioning when the first high-voltage pole 320 and the first low-voltage pole 330 from vehicle side electrical connector 3 is contacting with the second high-voltage pole 510 and the second low-voltage pole 520 from battery side electrical connector 5. And the cooperating structure of the locating pole 36 and the locating sleeve 54 can protect the high-voltage pole and low-voltage pole from suffering the affect due to the forces by radial direction after plugged-in.

In this embodiment, the number of locating pole can be set as two and installed at two sides of the mounting seat 12 and located outside of the high-voltage pole 130.

It is to be understood that the foregoing description of embodiment is intended to be purely illustrative of the principles of the invention, rather than exhaustive thereof, and that changes and variations will be apparent to those skilled in the art, and that the present invention is not intended to be limited other than expressly set forth in the following claims.

The invention claimed is:

1. An electrical connection device, comprising:

a vehicle side electrical connector including a first mounting seat, a first high-voltage assembly and a first low-voltage assembly, wherein the first high-voltage assembly and the first low-voltage assembly are configured to be inserted through the first mounting seat;

a battery side electrical connector including a second mounting seat, a second high-voltage assembly and a second low-voltage assembly, wherein the second high-voltage assembly and the second low-voltage assembly are configured to be inserted through the second mounting seat, wherein the first high-voltage assembly is in a separable planar electrical connection with the second high-voltage assembly, wherein the first high-voltage assembly comprises a first high-voltage pole, a flexible electrical connector and a high-voltage plug, wherein the first high-voltage pole includes an electrical contact end and a wiring end; wherein one end of the flexible electrical connector is in a floating electrical connection with the wiring end of the first high-voltage pole, the high-voltage plug is in a floating electrical connection with the other end of the flexible electrical connector;

wherein the flexible electrical connector adapts the relative displacement change in axial, radial and all directions between the first high-voltage pole and the high-voltage plug through a flexible cavity;

wherein the flexible electrical connector comprises a first electrical connector and a second electrical connector, wherein each ends of the flexible cavity is configured to be connected with the first electrical connector and the second electrical connector respectively.

2. The electrical connection device of claim 1, wherein the first low-voltage assembly is in a separable planar electrical connection with the second low-voltage assembly.

3. The electrical connection device of claim 2, wherein the first low-voltage assembly includes a first low-voltage pole which possesses an electrical contact end and a wiring end, and wherein the electrical contact end is protruded out of a surface opposite to the second mounting seat in the first mounting seat;

wherein the second low-voltage assembly includes a second low-voltage pole which possesses an electrical contact end and a wiring end, wherein the electrical contact end of the second low-voltage pole is parallel with one surface of the second mounting seat opposite to the first mounting seat, and wherein the electrical contact end of the second low-voltage pole is in a separable planar electrical connection with the electrical contact end of the first low-voltage pole.

4. The electrical connection device of claim 1, wherein the first mounting seat is in a detachable sealing connection with the second mounting seat, and wherein the first mounting seat is opposite to the second mounting seat.

5. The electrical connection device of claim 1, wherein a first pole mounting plate of the first mounting seat has a first high-voltage mounting hole, an outer wall surface of the first high-voltage pole is sleeved with elastic components, the elastic components are located in the first high-voltage mounting hole, and one side of the elastic components abuts against the first high-voltage mounting hole and other side of the elastic component abuts against the first high-voltage pole.

6. The electrical connection device of claim 1, wherein the electrical contact end of the first high voltage pole is protruded out of a surface opposite to the second mounting seat in the first mounting seat, wherein a groove is provided on an end surface of the electrical contact end, wherein the groove is recessed inward along axial direction of the first high-voltage pole, wherein a first conductive elastic component is embedded in the groove, and wherein the first conductive elastic component is protruded out of the surface of the end electrical contact end.

7. The electrical connection device of claim 1, wherein the second high-voltage assembly includes a second high-voltage pole, wherein the second high-voltage pole includes an electrical contact end and a wiring end, wherein the electrical contact end of the second high-voltage pole is parallel with a surface opposite to the first mounting seat in the second mounting seat, wherein the electrical contact end of the second high-voltage pole is in a separable planar electrical connection with the electrical contact end of the first high-voltage pole by the first conductive elastic component, and wherein the first conductive elastic component is configured to be pressed between the groove and the electrical contact end of the second high-voltage pole.

8. The electrical connection device of claim 7, wherein the groove is an annular groove, wherein the axis of the annular groove is in overlapped with axis of the first high-voltage pole; and/or wherein the first conductive elastic component is a conductive spring; and/or wherein contact surface of the electrical contact end of the first high-voltage pole and the second high-voltage pole are flat surfaces.

9. The electrical connection device of claim 1, wherein a wiring slot is provided on the wiring end of the first high-voltage pole, wherein the wiring slot is recessed inward along axial direction of the first high-voltage pole, wherein one end of the flexible electrical connector is configured to be pressed to connect with the wiring slot, and wherein a second conductive elastic component is pressed between inner walls of the wiring slot.

10. The electrical connection device of claim 1, wherein the flexible cavity is located outside the first high-voltage pole and the high-voltage plug, and is made of flexible conductive material.

11. The electrical connection device of claim 1, wherein one end of the first electrical connector is configured to be pressed to connect with the wiring slot, and wherein a second conductive elastic component is pressed located between the inner walls of the wiring slot;

and/or wherein the other end of the second electrical connector is in a planar electrical connection with the high-voltage plug.

12. The electrical connection device of claim 1, wherein the flexible electrical connector comprises a spring, wherein the spring is located within the flexible cavity, and two ends of the spring are connected with the first electrical connector and the second electrical connector respectively.

13. The electrical connection device of claim 1, wherein the high-voltage plug includes a plug pin, wherein the other end of the flexible electrical connector is in planar electrical connection with the plug pin of the high-voltage plug through a connecting socket base, wherein one end of the connecting socket base is provided with a first socket hole, and the other end of the connecting socket base is provided with a second socket hole, wherein one end of the flexible electrical connector is configured to be pressed to connect within the first socket hole, wherein the plug pin is in a planar connection with the second socket hole, and also a third conductive elastic component is configured to be pressed to connect within the flexible electrical connector and the inner wall of the first socket hole and/or the plug pin and the inner wall of the second socket hole.

14. The electrical connection device of claim 1, wherein the second mounting seat is provided with a high-voltage mounting hole, wherein the second high-voltage pole is configured to be inserted through the high-voltage mounting hole wherein outer wall surface of the second high-voltage pole is provided with a positioning section which is used to limit the movement of the second high-voltage pole relative to the second mounting seat along axial direction of the high-voltage mounting hole.

15. The electrical connection device of claim 14, wherein the positioning section are a protruding point, a protruding annulation, a wedge block or an agnail part, wherein the side wall of the high-voltage mounting hole is provided with a recessing section which is matched with the positioning section.

16. The electrical connection device of claim 14, wherein the first mounting seat is provided with a first low-voltage mounting hole which is inserted through first low-voltage pole is located at the first low-voltage mounting hole;

wherein the first low-voltage assembly also includes a rotating self-cleaning mechanism, comprising:

a guiding leg being located at the outer wall surface of the first low-voltage pole and extended outwards along radial direction of the first low-voltage pole;

a guiding slot being located at the side wall of the first low-voltage mounting hole, and wherein the guiding leg is configured to slide to the guiding slot, when the guiding leg moves within the guiding slot, and wherein the guiding leg and the guiding slot are matched with each other for limiting the rotating direction of the first low-voltage pole.

17. The electrical connection device of claim 16, wherein the outer wall surface of the first low-voltage pole is sleeved with an elastic component which is used to drive the first low-voltage pole to move along a rotating direction configured by the guiding slot and the guiding leg.

18. The electrical connection device of claim 16, wherein the longitudinal direction of the guiding slot and the central axis of the first low-voltage pole forms an angle.

* * * * *